US011247243B2

(12) United States Patent
Kløverpris et al.

(10) Patent No.: US 11,247,243 B2
(45) Date of Patent: Feb. 15, 2022

(54) METHOD AND APPARATUS FOR REJECTION OF DEFECTIVE MINERAL FIBRE SLABS

(71) Applicant: Rockwool International A/S, Hedehusene (DK)

(72) Inventors: Hans Kløverpris, Ribe (DK); Peter Nørgård, Hirtshals (DK)

(73) Assignee: Rockwool International A/S, Hedehusene (DK)

( * ) Notice: Subject to any disclaimer, the term of this patent is extended or adjusted under 35 U.S.C. 154(b) by 115 days.

(21) Appl. No.: 16/609,009

(22) PCT Filed: Apr. 23, 2018

(86) PCT No.: PCT/EP2018/060341

§ 371 (c)(1),
(2) Date: Oct. 28, 2019

(87) PCT Pub. No.: WO2018/197413

PCT Pub. Date: Nov. 1, 2018

(65) Prior Publication Data

US 2020/0206781 A1 Jul. 2, 2020

(30) Foreign Application Priority Data

Apr. 28, 2017 (EP) ..... 17168614

(51) Int. Cl.
*B07C 5/36* (2006.01)
*B07C 5/342* (2006.01)

(52) U.S. Cl.
CPC ..... *B07C 5/36* (2013.01); *B07C 5/342* (2013.01)

(58) Field of Classification Search
CPC .. B07C 5/36; B07C 5/342; B07C 5/34; B07C 5/14; B07C 9/00; G07C 3/143; B65B 35/24; B65B 35/44; B65G 47/57; B65G 49/05; B65G 49/06; B65G 2249/00; B65G 2201/022; B65G 2201/0282
See application file for complete search history.

(56) References Cited

U.S. PATENT DOCUMENTS 5,104,523 A * 4/1992 Masaharu ..... C03B 33/03 209/585
2003/0192412 A1 10/2003 Otto et al.

FOREIGN PATENT DOCUMENTS

EP 0569689 A2 11/1993
WO 95/20708 A1 8/1995
WO 2004096455 A1 11/2004

OTHER PUBLICATIONS

International Search Report dated Jun. 14, 2018, International Application No. PCT/EP2018/060341.

* cited by examiner

*Primary Examiner* — Michael McCullough
*Assistant Examiner* — Jessica L Burkman
(74) *Attorney, Agent, or Firm* — Dinsmore & Shohl LLP

(57) ABSTRACT

A method and apparatus for rejection of defective mineral fibre slabs in a continuous production process of mineral fibre slabs.

18 Claims, 9 Drawing Sheets

METHOD AND APPARATUS FOR REJECTION OF DEFECTIVE MINERAL FIBRE SLABS

CROSS-REFERENCE TO RELATED APPLICATIONS

This application is the U.S. national stage of PCT/EP2018/060341 filed Apr. 23, 2018, which claims priority of European Patent Application 17168614.0 filed Apr. 28, 2017 of which is hereby incorporated by reference in its entirety.

FIELD OF THE INVENTION

The present invention relates to a method and an apparatus for rejection of defective mineral fibre slabs.

BACKGROUND OF THE INVENTION

In the production of mineral wool fibrous slabs, a web of mineral wool fibres is formed from mineral fibres formed by heating mineral material in a furnace and then subjecting the molten mineral material to a spinning process whereby mineral fibres are created. A binder is applied to the fibres and they are collected to form a web of mineral fibrous material. This web is then cured in a curing oven in a continuous production system. An example of this production method is known from e.g. WO 95/20708.

The web is then trimmed and cut longitudinally (i.e. in the direction of travel of the web) and also transverse. The edges of the web may also be trimmed off and rows of adjacent, rectangular slabs appear on the conveyor. These slabs are then transferred to a stacking operation where they are stacked and packed.

Before the packing, the slabs in each row are passed through a quality check where the slabs are checked for imperfections and if one of the slabs in a particular row is found defective, the entire row is taken out of the flow feeding the stacking equipment, since the stacking equipment requires the feeding of complete rows of adjacent slabs in order to perform a satisfactory stacking operation. The slabs in the row with one or more defective slabs are returned to reprocessing by being granulated and then remelted the material in the furnace and thereby reused. This has the unfortunate downside that non-defective slabs are being rejected if one or more of the other slabs in the same row contain(s) defects.

In the typical dimensions of mineral wool fibre slabs produced, three slabs are contained in each row and a rejection rate of 7% or even up to 12% may be experienced in the production. Although the rejected slabs are recycled so no material goes to waste, there is nevertheless a desire to reduce the number of rejected slabs as this would increase the efficiency of the production and reduce the production costs. Therefore, it is an object of the present invention to reduce the number of rejected slabs to increase the production output.

SUMMARY OF THE INVENTION

This object is achieved according to a first aspect of the invention by the provision of a method for rejection of defective mineral fibre slabs in a continuous production process of mineral fibre slabs, said method comprising the steps of:

providing a continuous flow of rows of a predetermined number of mineral fibre slabs on a first conveyor with a first direction of travel;

detecting each of the slabs in a row for defects;

redirecting one or more defective slabs onto a second conveyor for further processing and transferring the remaining non-defective slabs in a row to a third conveyor, downstream of the first conveyor and having a third direction of travel; or if no defective slabs are detected in the row, the entire row is continued onto a fourth conveyor and onwards to a fifth conveyor both being downstream of the first conveyor and has the same direction of travel as the third conveyor;

receiving the non-complete row of non-defective slabs from the third conveyor on a buffer table, and assembling a complete row from non-defective slabs received on said buffer table and transferring said assembled complete row onto the fifth conveyor.

By the invention it is realised that the effective rejection rate can be reduced as only defect slabs are singled out and rejected while non-defective slabs are regrouped in a new row on the buffer table and returned to the continuous flow of rows of slabs for the packaging station. This is achieved as at the buffer table the otherwise continuous flow of rows is discontinued and the non-defective slabs of a non-complete row are stored on the buffer table and a new row is formed. This increases the output rate of the production line and the amount of slabs that are recycled is reduced. Hereby the efficiency and the profitability of the production line for mineral wool slabs are increased.

At the buffer table, it is found advantageous that the step of assembling of a complete row on the buffer table comprises a transverse receiving line and an assembling line parallel to the receiving line, said assembling involves shuffling the received non-defective slabs in a transverse direction to the flow direction in the transverse receiving line and then one or more non-defective slabs are transferred onto the assembling line. Furthermore, the buffer table has capacity of at least one extra slab than the predetermined number of slabs in a row, so that the receiving line and the assembling line comprise at least one extra slab position.

Preferably, the position(s) of the non-defective slab(s) received on receiving line of the buffer table is/are detected by one or more detectors or otherwise known from the feeding second conveyor.

According to a preferred embodiment, the position(s) of the slabs received on the receiving line of the buffer table are registered in a controlling unit adapted to comparing the position of the at least one slab on the assembling line with the detected position(s) and transversely shifting the position of the received slab(s) on the receiving line, so that the slab(s) are positioned in the assembling line in non-preoccupied positions thereon.

In the preferred embodiment of the invention, a first transfer conveyor is provided between the first conveyor and the second and third conveyors. This first transfer conveyor has individually movable transfer conveyors arranged adjacent each other corresponding to the predetermined number of slabs in a row so that the defective slabs are redirected to the second conveyor and non-defective slabs are transferred onto the third conveyor. In the currently preferred embodiment, the second conveyor receiving the defective slabs is arranged above the third conveyor. Due to the individually moveable transfer conveyors the defective as well as the non-defective slabs in a particular row can be transferred in a continuous motion without disrupting the flow on the conveyor system.

Furthermore, the third conveyor is preferably movable from a first position for delivery of non-defective slabs onto the buffer table and a second position for delivering a complete row of non-defective slabs onto the fourth conveyor. In the currently preferred embodiment, this fourth conveyor is arranged as a by-pass in a level above the buffer table where the rows of slabs continue to move forward in a continuous motion on the fourth conveyor.

In the currently preferred embodiment, three mineral fibre slabs are provided in each row. However, it is realised that the predetermined number of slabs in the rows can be any other number, e.g. two, four, five or even more.

The detecting involves in an embodiment of the invention visual detection by one or more sensors. It is found advantageous to detecting for at least two types of defects, such as material defects, incomplete size or slabs with not fully cured binder. This is advantageous as the defective slabs can then be further divided as forwarded for further processing depending on the type of defect detected as the further processing of defective slabs may preferably involve sorting the boards according to types of defects.

In a second aspect of the invention, there is provided an apparatus for rejection of mineral fibre slabs in a continuous production process of mineral fibre slabs, said apparatus comprising:

a first conveyor with a first direction of travel transporting a continuous flow of rows of a predetermined number of mineral fibre slabs thereon;

one or more sensor elements detecting each of the slabs in a row for defects;

a second conveyor for receiving one or more defective slabs which are redirected for further processing and a third conveyor receiving the remaining non-defective slabs in an incomplete row, said third conveyor being provided downstream of the first conveyor and having a third direction of travel;

a fourth conveyor provided downstream of the first conveyor and with the same direction of travel as the third conveyor, said fourth conveyor adapted for receiving a complete row with non-defective slabs and transferring said row of non-defective slabs onto a fifth conveyor; and a buffer table for receiving the non-complete row of non-defective slabs from the third conveyor, and whereon a complete row from the slabs received on said buffer table is assembled and said assembled complete row of non-defective slabs is transferred onto the fifth conveyor.

Hereby a single slab rejection system performing the method described above is provided. The apparatus provides for a reduction of the effective rejection rate as only defect slabs are singled out of the product flow and rejected while all non-defective slabs are regrouped in a new row on the buffer table and returned to the continuous flow of rows of slabs for the packaging station. This increases the output rate of the production line and the amount of slabs that are recycled is reduced. Hereby, the efficiency and the profitability of the production line for mineral wool slabs are increased.

BRIEF DESCRIPTION OF THE DRAWINGS

In the following the invention is disclosed in more detail with reference to the accompanying drawings, in which.

DETAILED DESCRIPTION OF THE INVENTION

Figure 1:
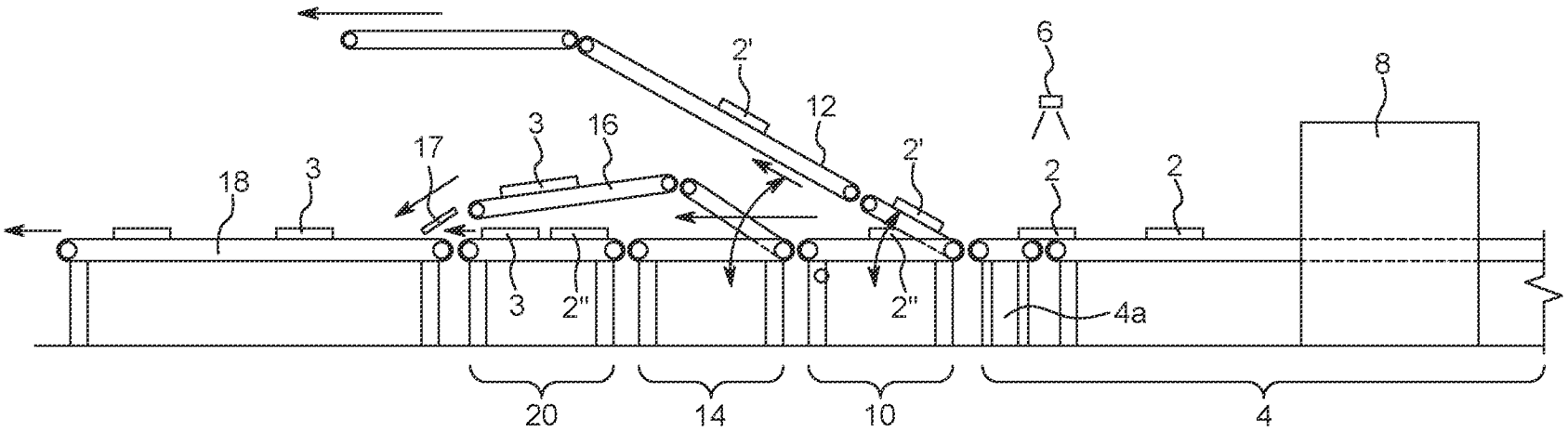
FIG. 1 is a schematic side view of the sorting section of the production line for producing mineral wool fibre slabs.
Figure 2:
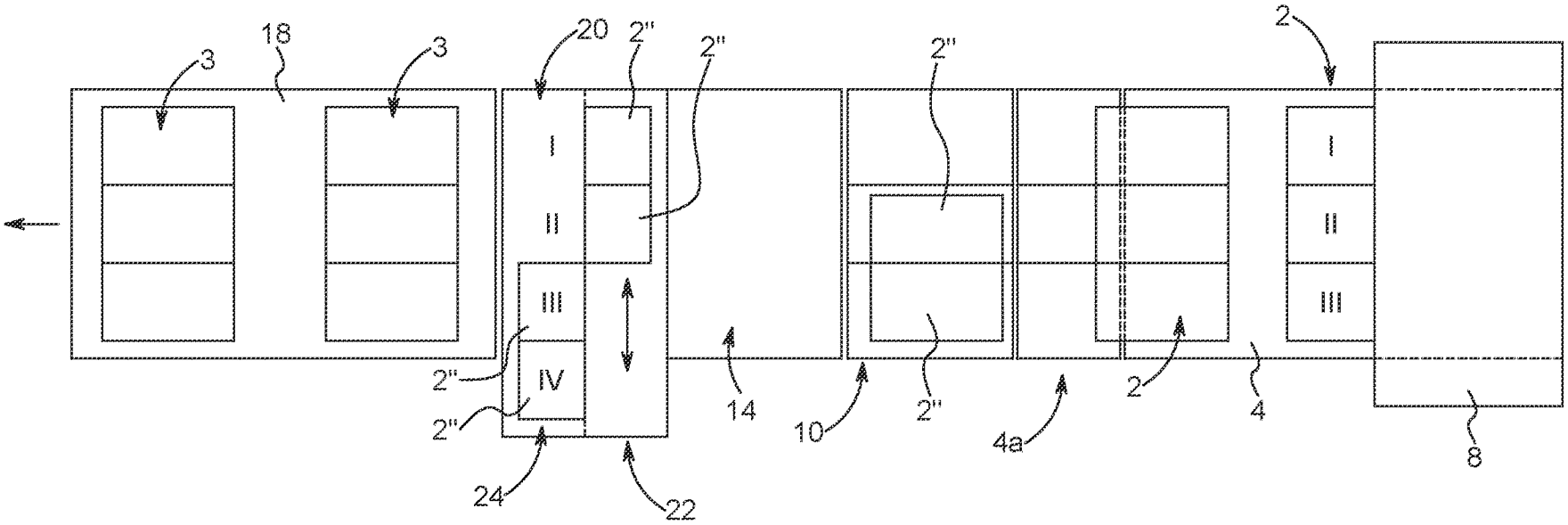
FIG. 2 is a top view of same.

With reference to FIGS. 1 and 2, rows of mineral wool slabs 2 are provided on a first conveyor 4 coming out of the forming process, such as a curing oven and cutting devices 8, on the production line. Each row of slabs 2 comprises in the shown embodiment three adjacent slabs 2 (see FIG. 2: I; II; III). The rows of slabs 2 flow on the conveyor 4 in a continuous manner. Each row 2 is separated though with a predetermined space.

On the first conveyor 4, the rows of slabs 2 are detected by scanning equipment 6 positioned at the downstream end 4*a* of the first conveyor 4. By the scanning equipment 6 each slab 2 is scanned for defects. In a control system (not shown) the detections of the slabs 2, 2', 2" are registered and the defective slabs 2' are redirected by a transfer conveyor 10, which—as indicated in FIG. 2—comprise three adjacent pivoting conveyors. The one or more defective slabs 2' in a row are forwarded onto a second conveyor 12, and the non-defective slabs 2" are transferred further to a third conveyor 14 downstream of the transfer conveyor 10.

The third conveyor 14 is pivotably arranged so that if an entire row of non-defective slabs 2" arrives on the third conveyor 14, the conveyor is pivoted upwards for forwarding the complete row 3 of non-defective slabs 2" onto a fourth conveyor 16. From the fourth conveyor 16, which constitutes a bridging path for the complete rows 3 over the buffer table 20, the rows of slabs 3 are—potentially via a chute 17—delivered onto a fifth conveyor 18.

The flow of slabs from the first to the fifth conveyor 4, 10, 14, 16, 18 is in a continuous manner with a predetermined flow rate.

If the row arriving on the third conveyor 14 is non-complete, but instead comprise one or two non-defective slabs 2", these non-defective slabs 2" are transferred onto a buffer table 20 whereon slabs 2" from non-complete rows are reassembled into complete rows 3. When a complete row of slabs 3 is reassembled, the row 3 is transferred onto the fifth conveyor 18.

This buffer table 20 includes two parallel transverse lines 22, 24 each with four lateral positions I, II, III, IV (see FIG. 2), where the first three positions correspond to the three lateral positions in the rows on the conveyors 4, 10, 14. The position or positions of the non-defective slabs 2" arriving on the receiving line 22 is/are known. On the assembling line 24, which is downstream in the conveyor direction of the receiving line 22, one or more slabs 2" may already be present and their position(s) is/are known. The arriving slabs 2" on the receiving line 22 may be transferred sideways, i.e. in the lateral direction relative to the direction of the conveyors, so that the slabs 2" on the receiving line 22 are brought into a lateral position corresponding to a free position on the assembling line 24. Advantageously, the slabs 2" on the assembling line 24 may also be moved laterally to provide free (non-preoccupied) positions for the incoming slabs 2". The slab or slabs 2" of the receiving line is/are then forwarded to the assembling line 24 for the forming of a complete row of slabs 2". When the reassembled complete row of slabs 3 is formed on the buffer table 20, the row is transferred onto the fifth conveyor 18 for further processing.

Figure 9:
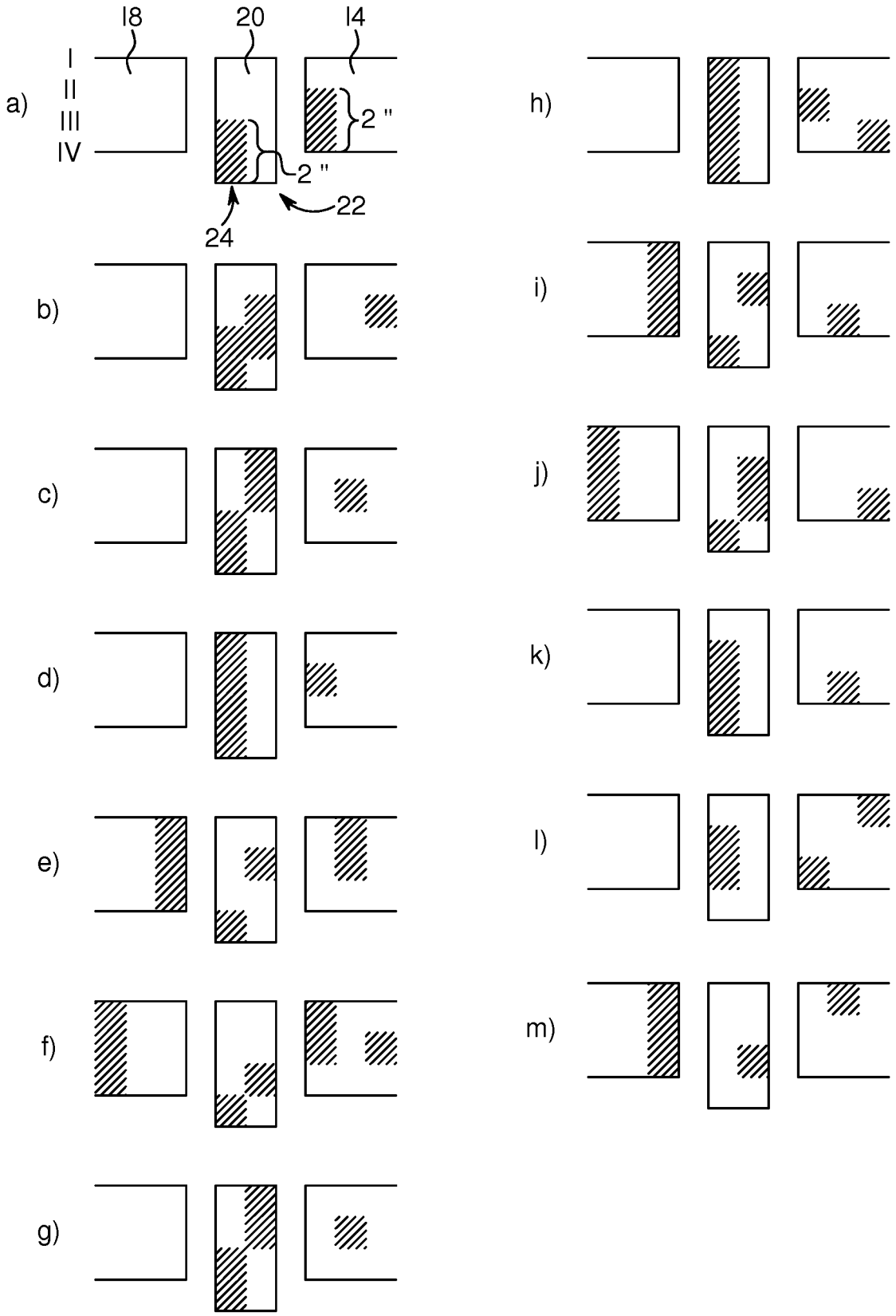
FIG. 9 *a*) to *m*) show schematically how the sorting is performed on the buffer table in an apparatus and a method according to the invention.

An example of the steps for forming a complete row 3 of non-defective slabs 2" is shown sequentially in FIG. 9, where a) to m) schematically illustrate how the slabs 2" are received onto the buffer table 20 from the third conveyor 14, transferred laterally and forwarded on the buffer table 20 and then further transferred to the fifth conveyor 18.

Figure 3:
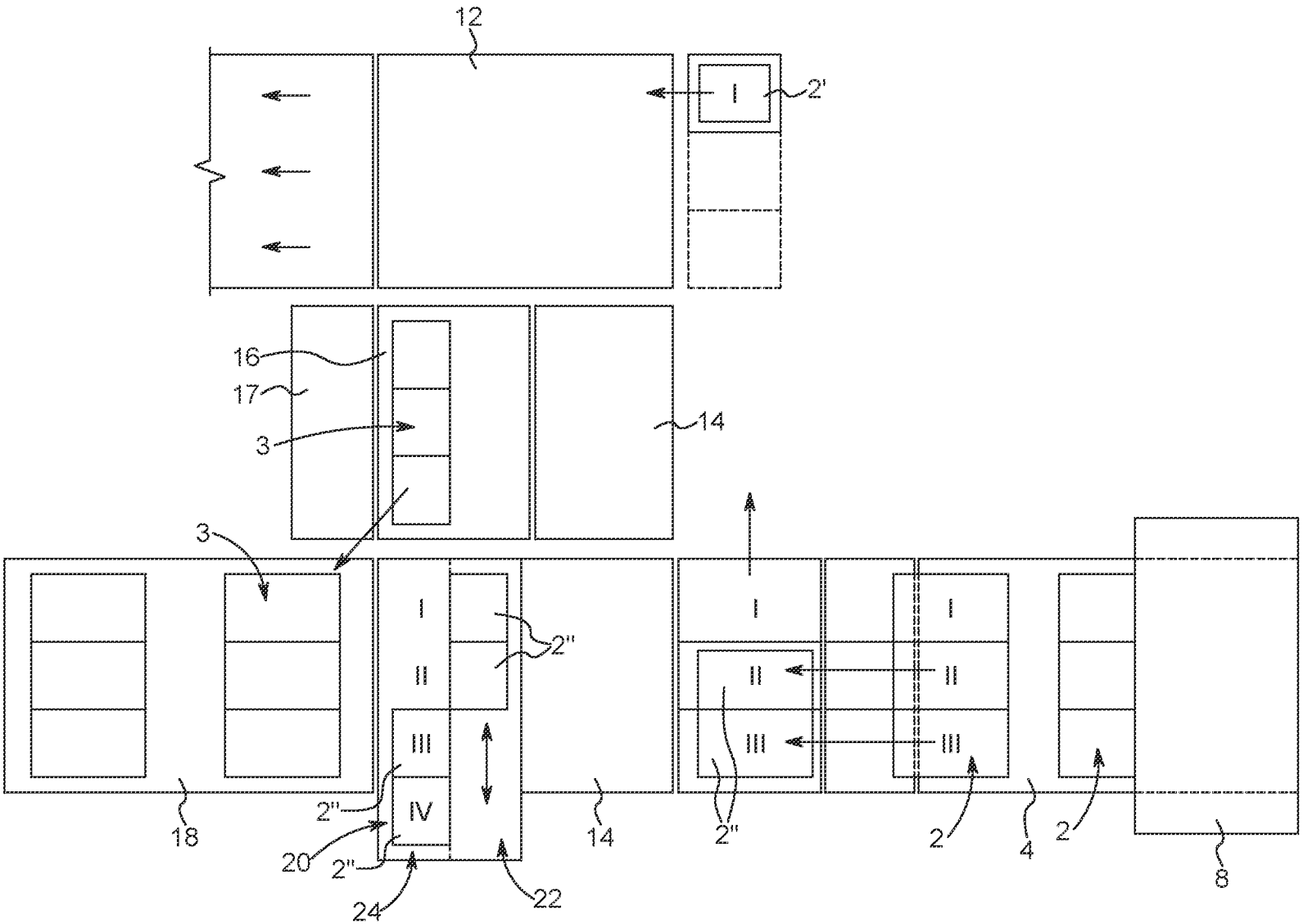
FIG. 3 is an exploded top view of the sorting section in FIGS. 1 and 2 illustrating each level of conveyor systems.

In FIG. 3, the levels of the conveyor layout shown in FIG. 1 is shown schematically with the second conveyor 12 which is at the top above in the figure, and below is the third conveyor 14 and the "main flow path" with the buffer table 20 is shown in the lowermost section of FIG. 3. The transfers of slabs 2', 2" are from the first conveyor 4 onto the second conveyor 12 or the third conveyor 14 and then either onto the buffer table 20 or the fourth conveyor 16 whereafter the complete rows 3 of non-defective slabs 2" are provided on the fifth conveyor 18 and conveyed onwards to further processing, such as stacking and packaging.

FIGS. 4 to 8 show some schematic, perspective illustrations of an embodiment of the present invention showing the sorting section of a production line producing mineral fibre wool panels or slabs. The rows of slabs 2 are in a continuous flow through the sorting section. The rows of slabs 2 in the present embodiment consists of three slabs, but could be a different number dependent on the width of the mineral wool fibre web produced upstream the production line (not shown) and what the predetermined (standard) width of the slabs is.

The rows of slabs 2 exit the processing station, such as the curing oven and cutting devices 8, upstream the sorting section of the production line. The rows of slabs 2 have been cut into slabs and split into separated rows of slabs 2 in the upstream process. By scanning equipment 6 (see FIG. 1) the slabs in each row are scanned for defects, and the positions of defective slabs 2' as well as the positions of non-defective slabs 2" are recorded while the slabs are forwarded on the first conveyor 4.

Figure 4:
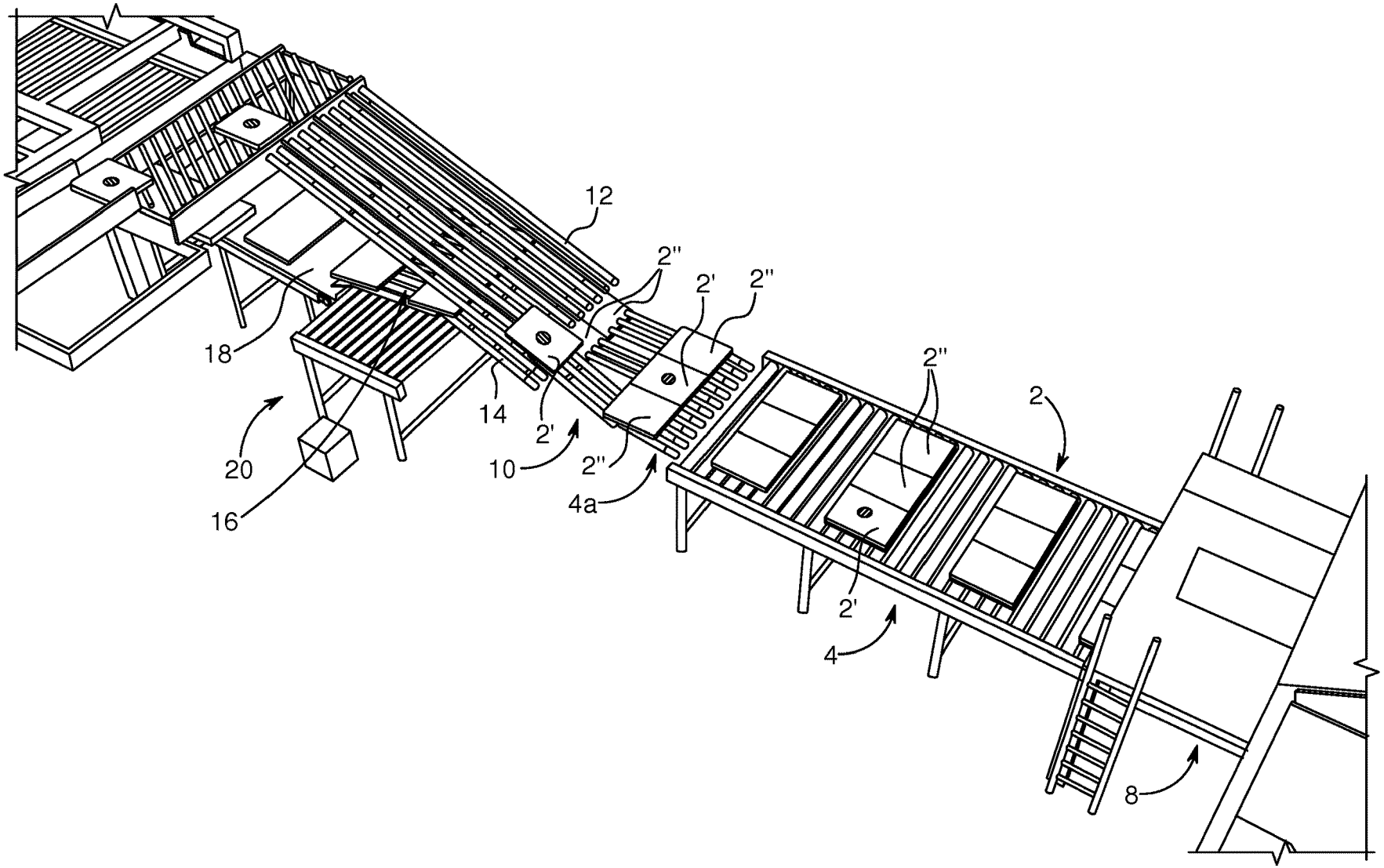
FIGS. 4-8 are perspective views of the sorting section of the production line as the rows of slabs flow through the sorting section according to the invention.

The first conveyor 4 is in the present embodiment a roller conveyor where the rows of slabs are transported towards the downstream end 4*a* of the first conveyor 4 (i.e. from right to left in the FIGS. 4 to 8). At the downstream end 4*a*, the first conveyor may be provided with three adjacent conveyors corresponding to the positions of the three slabs in the rows. Downstream the first conveyor 4, a transfer conveyor 10 is provided. This transfer conveyor consists of three adjacent, individually pivotable, conveyors corresponding to the positions of the slabs in the rows such that each slab in a row of slabs 2 is received by each their transfer conveyor 10. As indicated in FIG. 4, a defective slab 2', which is positioned in the left position in the row of slabs, is pivoted upwards and transferred to a second conveyor 12, while the other two non-defective slabs 2" (i.e. the slabs in the middle and right positions in the row) are conveyed by the transfer conveyor 10 with the conveyors in a lowermost position onwards to the third conveyor 14, which is located underneath the second conveyor 12.

As indicated in the FIGS. 4-8 the defective slabs 2' transferred onto the second conveyor 12 may be transferred onwards for recycling or other processing. In a particular embodiment, the detectors scanning the row of slabs 2 may be adapted to detecting different kinds of defects, such as uncured material and defective material or dimensions. From the second conveyor 12 the defective slabs 2' can be transported to either extra curing or for recycling.

The non-defective slabs 2" are received on the third conveyor 14, which is also individually pivotable between a lowermost, horizontal position for forwarding the non-defective slabs 2" onto a buffer table 20 or an uppermost position for forwarding a complete row of non-defective slabs 2" onto a fourth conveyor 16.

Figure 5:
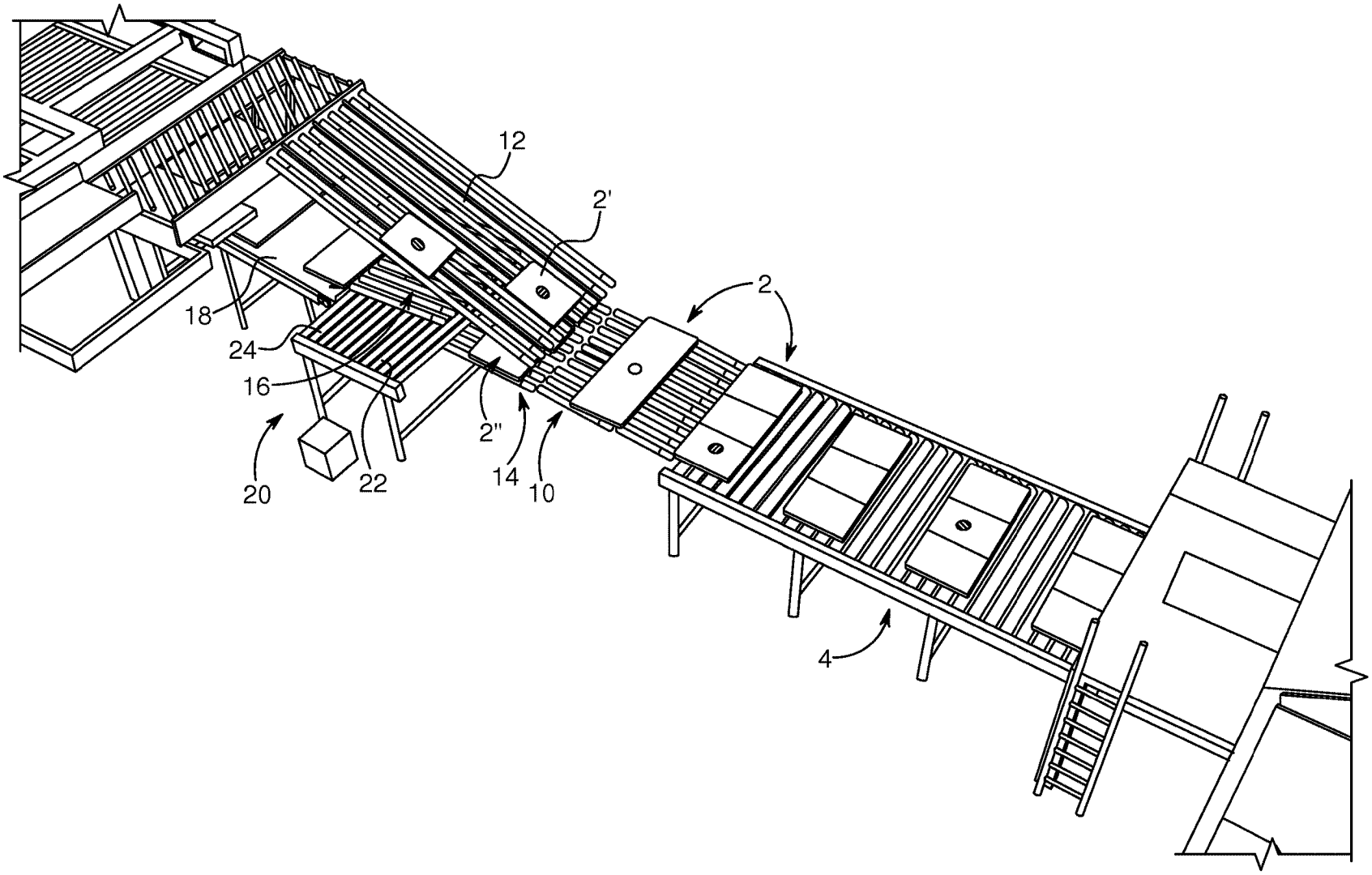

If a non-complete row of non-defective slabs 2" is received on the third conveyor 14 (as shown in FIG. 5), the third conveyor 14 is kept in a low (horizontal) position and the non-defective slab or slabs 2" are forwarded to the buffer table 20.

Figure 6:
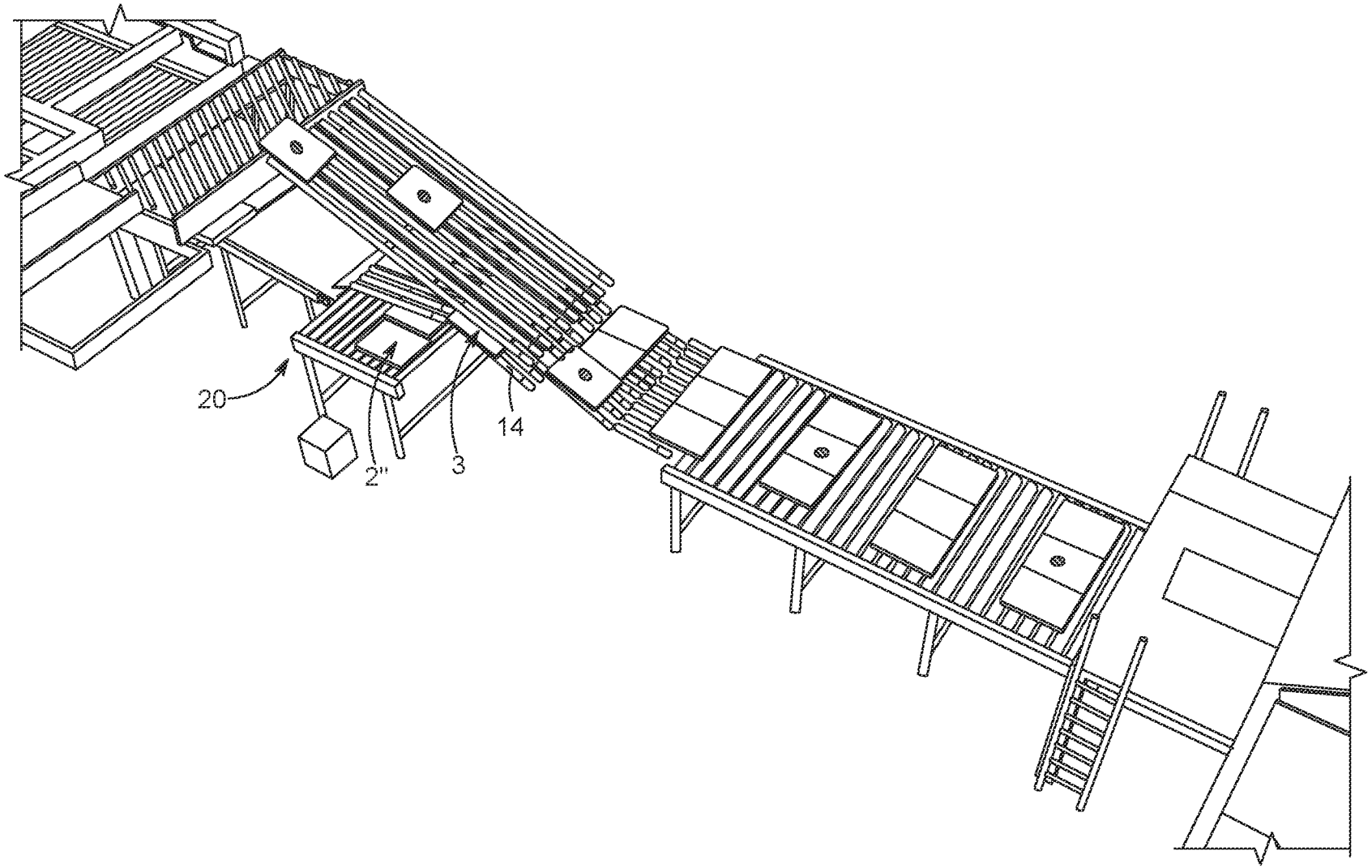
Figure 7:
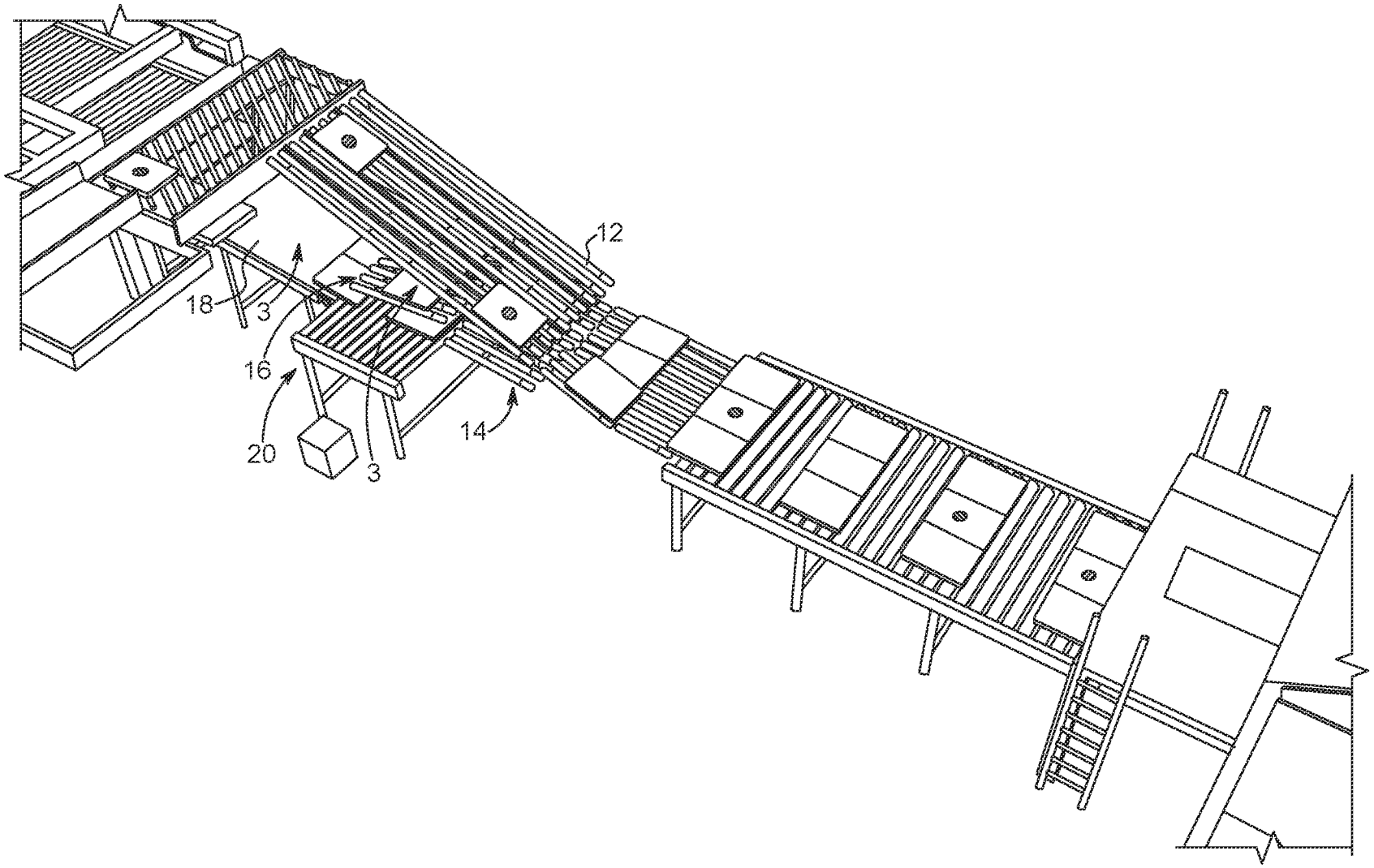
Figure 8:
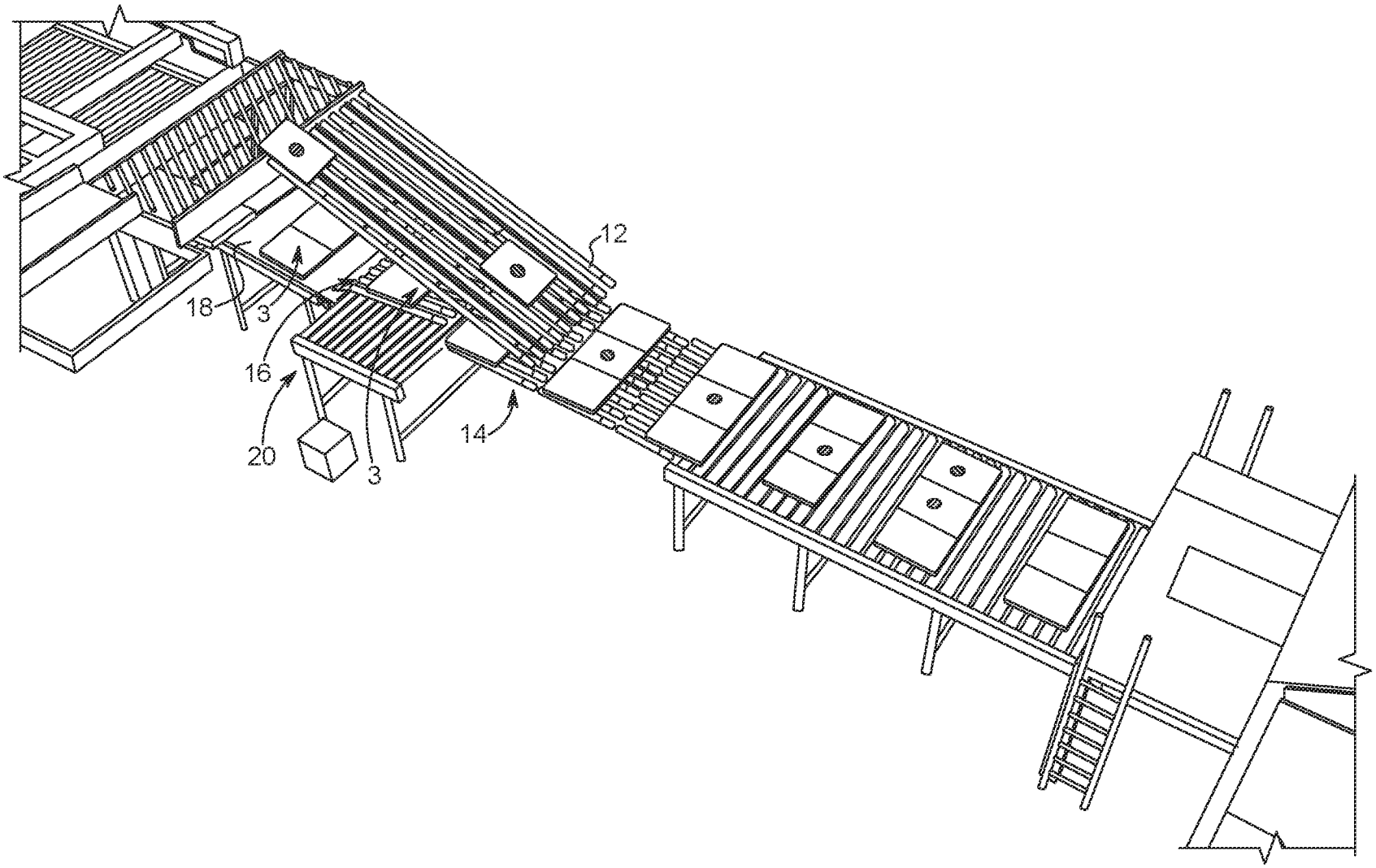

As shown in FIGS. 6-8, when a complete row 3 of non-defective slabs 2" is received on the third conveyor 14, the row 3 of non-defective slabs 2" is pivoted upwards (FIG. 6) and the complete row 3 is delivered onto the fourth conveyor 16 (FIGS. 7 and 8). From the fourth conveyor 16 the rows 3 of non-defective slabs 2" are forwarded onto a fifth conveyor 18, which is positioned downstream the buffer table 20. In order to ensure that the slabs maintain their positions in the rows, a chute 17 may be provided so that the row of slabs 3 is dropped onto the fifth conveyor 18 in a gentle manner.

The one or two non-defective slabs 2" in their original position(s) in the row is/are delivered onto the buffer table 20. The buffer table extends sideways so that it comprises at least one extra position IV relative to the number of slabs in a row of slabs 2. The slabs 2, 2', 2" flow in a continuous manner through the first, second or third and fourth conveyors 4, 10, 14, 16, but when the slabs 2" are received on the buffer table 20 the flow is discontinued. The slabs 2" are received on the receiving line 22 on the buffer table 20.

The sorting method performed on the buffer table 20 is schematically shown in FIG. 9 *a*) to *m*).

The position(s) of the received non-defective slabs 2" is known in the controlling system and the slabs 2" may be moved sideways, see e.g. FIGS. 9*b*) to 9*c*), and then forwarded to the assembling line 24 which is downstream (relative to the overall flow direction) the receiving line 22 of the buffer table 20. The slabs 2" coming from the third conveyor 14 in FIG. 9*a*) are received on the receiving line 22 of the buffer table (FIG. 9*b*) and then moved sideways (see FIG. 9*c*) to fit with free positions on the assembling line 24 and then the slabs 2" are forwarded onwards to the free positions on the assembling line 24 (FIG. 9*d*). Hereby, a complete row 3 of non-defective slabs 2" is reassembled and the row of slabs 3 is then transferred from the buffer table 20 onto the fifth conveyor 18 in between the complete rows of slabs 3 delivered to the fifth conveyor 18 from the fourth conveyor 16.

As indicated in FIG. 9*e*) a non-defective slab 2" is left on the assembling line 24 of the buffer table 20 and the next build-up or reassembling of a row of slabs 3 can then continue as illustrated in the FIGS. 9*f*) through to 9*m*).

By this parallel sorting process on the buffer table 20, it is ensured that only complete rows of slabs 3 are forwarded to the packaging process (not shown) further downstream the sorting unit on the production line. This is advantageous as the packaging process requires the receipt of complete rows in order to perform the stacking of the slabs.

Above a preferred embodiment of the invention is described. However, it is realised that variants and equivalent solutions may be provided without departing from the scope of the invention as defined in the accompanying claims.

The invention claimed is:

1. A method for rejection of defective mineral fibre slabs in a continuous production process of mineral fibre slabs, said method comprising the steps of:

providing a continuous flow of rows of a predetermined number of mineral fibre slabs on a first conveyor with a first direction of travel;

detecting each of the slabs in a row for defects;

redirecting one or more defective slabs onto a second conveyor for further processing and transferring the remaining non-defective slabs in a row to a third conveyor downstream of the first conveyor and having a third direction of travel; or if no defective slabs are detected in the row, the entire row is continued onto a fourth conveyor and onwards to a fifth conveyor both being downstream of the first conveyor and has the same direction of travel as the third conveyor;

receiving the non-complete row of non-defective slabs from the third conveyor on a buffer table, and assembling a complete row from non-defective slabs received on said buffer table and transferring said assembled complete row onto the fifth conveyor.

2. A method according to claim 1, whereby the step of assembling of a complete row on the buffer table comprises a transverse receiving line and an assembling line parallel to the receiving line, said assembling involves shuffling the received non-defective slabs in a transverse direction to the flow direction in the transverse receiving line and then one or more non-defective slabs are transferred onto the assembling line.

3. A method according to claim 1, whereby the buffer table has capacity of at least one extra slab than the predetermined number of slabs in a row, so that the receiving line and the assembling line comprise at least one extra slab position.

4. A method according to claim 1, whereby the step of redirecting is performed by a first transfer conveyor having individually movable transfer conveyors corresponding to the predetermined number of slabs in a row.

5. A method according to claim 1, whereby three mineral fibre slabs are provided in each row.

6. A method according to claim 1, whereby the step of detecting each of the slabs involves visual detection by one or more sensors.

7. A method according to claim 1, whereby the step of detecting each of the slabs involves at least two types of defects, such as material defects, incomplete size or slabs with not fully cured binder.

8. A method according to claim 1, whereby the further processing of defective slabs involves sorting the boards according to types of defects.

9. A method according to claim 1, whereby the position(s) of the non-defective slab(s) received on receiving line of the buffer table is/are detected.

10. A method according to claim 9, further including a step of comparing the position of the at least one slab on the assembling line with the detected position(s) and transversely shifting the position of the received slab(s) on the receiving line so that the slab(s) are positioned in the assembling line in non-preoccupied positions thereon.

11. An apparatus for rejection of mineral fibre slabs in a continuous production process of mineral fibre slabs, said apparatus comprising:

a first conveyor with a first direction of travel transporting a continuous flow of rows of a predetermined number of mineral fibre slabs thereon;

one or more sensor elements detecting each of the slabs in a row for defects;

a second conveyor for receiving one or more defective slabs which are redirected for further processing and a third conveyor receiving the remaining non-defective slabs in an incomplete row, said third conveyor being provided downstream of the first conveyor and having a third direction of travel;

a fourth conveyor provided downstream of the first conveyor and with the same direction of travel as the third conveyor, said fourth conveyor adapted for receiving a complete row with non-defective slabs and transferring said row of non-defective slabs onto a fifth conveyor; and a buffer table for receiving the non-complete row of non-defective slabs from the third conveyor, and whereon a complete row from the slabs received on said buffer table is assembled and said assembled complete row of non-defective slabs is transferred onto the fifth conveyor.

12. An apparatus according to claim 11, wherein a first transfer conveyor is provided having individually movable transfer conveyors corresponding to the predetermined number of slabs in a row so that the defective slabs are redirected to the second conveyor.

13. An apparatus according to claim 11, wherein the third conveyor is movable from a first position for delivery of non-defective slabs onto the buffer table and a second position for delivering a complete row of non-defective slabs onto the fourth conveyor.

14. An apparatus according to claim 11, wherein three mineral fibre slabs are provided in each row.

15. An apparatus according to claim 11, wherein the buffer table comprises a transverse receiving line and an assembling line parallel to the receiving line, both lines adapted to shuffling the received slabs in a transverse direction to the flow direction of the conveyors in the transverse receiving line and then one or more slabs are transferred onto the assembling line.

16. An apparatus according to claim 15, wherein the buffer table has capacity of at least one extra slab than the predetermined number of slabs in a row, so that the receiving line and the assembling line comprise at least one extra slab position.

17. An apparatus according to claim 15, wherein the position(s) of the non-defective slab(s) received on receiving line of the buffer table is/are detected by one or more detectors.

18. An apparatus according to claim 17, wherein a controlling unit is provided adapted to comparing the position of the at least one slab on the assembling line with the detected position(s) and transversely shifting the position of the received slab(s) on the receiving line so that the slab(s) are positioned in the assembling line in non-preoccupied positions thereon.

* * * * *